US007021594B2

(12) United States Patent
Exler

(10) Patent No.: US 7,021,594 B2
(45) Date of Patent: Apr. 4, 2006

(54) FOLDING MAGNETIC HOLDING WRAP FOR CUPS OR MUGS

(75) Inventor: Timothy W. Exler, Pittsburgh, PA (US)

(73) Assignee: Magna-Mug LLC, Harrison, OH (US)

( * ) Notice: Subject to any disclaimer, the term of this patent is extended or adjusted under 35 U.S.C. 154(b) by 0 days.

(21) Appl. No.: 10/851,252

(22) Filed: May 21, 2004

(65) Prior Publication Data

US 2005/0001125 A1 Jan. 6, 2005

Related U.S. Application Data

(63) Continuation of application No. 10/082,834, filed on Feb. 25, 2002, now abandoned.

(51) Int. Cl.
*A47K 1/08* (2006.01)

(52) U.S. Cl. ..... 248/311.2; 248/205.2; 248/206.5

(58) Field of Classification Search ..... 248/311.2, 248/206.5, 205.2, 683; 24/303, 306; 493/374, 493/293

See application file for complete search history.

(56) References Cited

U.S. PATENT DOCUMENTS 2,217,514 A * 10/1940 Henry ..... 220/628
3,921,620 A 11/1975 Nakayama
3,943,912 A 3/1976 Nakayama
4,480,596 A 11/1984 Shumiyashu
4,596,370 A * 6/1986 Adkins ..... 248/311.2
4,678,154 A 7/1987 McFarland
4,878,585 A 11/1989 Orestano
4,928,873 A * 5/1990 Johnson ..... 220/738
4,989,811 A * 2/1991 Millis et al. ..... 248/104
5,104,076 A 4/1992 Goodall, Jr.
5,186,350 A * 2/1993 McBride ..... 220/412
5,256,131 A 10/1993 Owens et al.
5,320,249 A 6/1994 Strech
5,425,497 A 6/1995 Sorsensen
5,582,028 A 12/1996 Rilling et al.
5,707,333 A 1/1998 Bakst (Continued)

FOREIGN PATENT DOCUMENTS

DE 197 43 820.2 6/2004

*Primary Examiner*—Ramon O Ramirez
(74) *Attorney, Agent, or Firm*—Daniel F. Nesbitt; Hasse & Nesbitt LLC

(57) ABSTRACT

An improved holder for receiving a liquid-containing device and mounting it onto a magnetic accepting support or surface is provided having a foldable single unit wrap element with a magnetic means secured to the outer surface of the wrap element.

18 Claims, 18 Drawing Sheets

U.S. PATENT DOCUMENTS 5,738,080 A 4/1998 Brocco, Jr.
5,782,743 A 7/1998 Russell
5,791,608 A 8/1998 Nielsen et al.
5,794,843 A 8/1998 Sanchez
5,873,486 A * 2/1999 Morgan ..... 220/739
6,006,934 A * 12/1999 Skrysak ..... 220/9.1
6,065,632 A 5/2000 Moore, Jr.
D426,640 S 6/2000 Bell et al.
6,093,143 A 7/2000 Nagler
6,145,715 A 11/2000 Slonim
6,193,202 B1 2/2001 Rogers
6,286,798 B1 9/2001 Chun
6,305,656 B1 * 10/2001 Wemyss ..... 248/309.4
6,318,689 B1 11/2001 Rodriguez
2003/0159952 A1 * 8/2003 Lewis et al. ..... 206/217
2004/0021049 A1 * 2/2004 Payne et al. ..... 248/310
2004/0104320 A1 6/2004 Exler

* cited by examiner

FOLDING MAGNETIC HOLDING WRAP FOR CUPS OR MUGS

CLAIM OF PRIORITY

This application is a continuation of U.S. patent application Ser. No. 10/082,834 filed Feb. 25, 2002 now abandoned.

FIELD OF INVENTION

The present invention relates generally to a holding apparatus for a liquid-containing device and, more particularly, to a cup holding device receiving a cup and mounting it on a metal support or surface.

BACKGROUND OF INVENTION

Cup holders have been designed to ease the handling of cups. Conventional cup holders typically have a cylindrical shape which is designed to encircle the sides of a cup while leaving its bottom essentially open. These holders can affix about the curvature of the cup. They may have a fluted appearance allowing retention of a cup with tapered sides. Cup holders have also been incorporated into other structures to provide a fixed-in-place support, such as in a dashboard, door or center section of a motor vehicle, or in the armrest of a movie theater or stadium chair. Holders may also be donned in an insulated or padded pocket of a garment or a lumbar carrying pack to free the hands of a user.

Cup holders may be constructed of a variety of materials, depending upon the intended use. For example, holders comprise of rigid materials, such as a synthetic polymer, plastic or polyethylene vinyl chloride, or flexible plastic, foam, plastic covered foam or neoprene. They may also be constructed of pressed material such as paper pulp and have multiple nubs or depressions therein.

In addition to aiding the gripability of the cup, cup holders can enhance a cup's insulation ability, block condensation or add a decorative feature.

In all of these cases where cup holders have been designed for the ease of the user, none have offered an adjustable, folding portable metal-supportable cup holder.

Accordingly, it is an object of the present invention to provide a cup holder having the capability of being supported by a metal magnetic accepting support or surface. It is a further object of the invention that the holder be adaptable to accommodate a variety of liquid-containing devices such as, for example, different types and sizes of cups, mugs, bottles and cans. In other embodiments, the magnetic holding wrap can be adapted to hold bathroom products, such as toothbrushes, toothbrush holders, razors, shampoo or conditioner bottles and other items. More particularly, an object of the invention is to provide a reusable folding cloth or reinforced neoprene magnetic wrap that can be covered having a fastener to allow the ends of the wrap to removably secure about a liquid-containing device. Another object is to provide a wrap that insulates, comforts and magnetically attaches to any magnetic accepting surface while supporting a liquid-containing device.

SUMMARY OF INVENTION

The present invention is directed towards an improved holder for holding a liquid-containing device and mounting it on a metal support or surface. A liquid-containing device, or as referred to generally herein as a "cup," includes, but is not limited to, a cup, mug, can, bottle, flask or other similar container. The invention generally comprises a wrap element having a first surface, a second surface, two ends, at least one attachable means on each such surface, and a magnetic means provided on or in a portion of the first surface. The wrap element has a generally elongated form, but in certain situations a square shape is better suited for the intended end use. For instance, the shape of the wrap element can be designed to cover a more, or less, substantial portion of the cup outer surface or a larger or smaller cup by altering elongation.

The wrap element is made of any material in a size and durability capable of accommodating a cup. Preferably, it is constructed of a synthetic polymer, such as polychloroprene or neoprene rubber, or foam. Neoprene rubber is known to display outstanding physical toughness, flexibility, resistance to damage from use and weather and has good resilience. The rubber may be used raw or exposed, or it can be covered with a natural or synthetic cloth for the finished wrap element. The covered wrap element offers a decorative feature as well as a protective barrier to those who may be allergic to rubber. Regardless of the cover, the wrap element first surface may have ornamental features or multiple coverings may be applied to the whole or a part of the first surface to add a decorative or textured feature.

The magnetic means may consist of one or more magnets affixed to the first surface with adhesive and covered with a patch to secure the magnet or magnets to the first surface. Alternatively, the magnetic means may sit in a crevice or indent portion of the first surface thereby making the magnet means flush with the wrap element first surface. It may also be completely embedded into the wrap element such that magnetic means is entirely or partially concealed by the wrap element . Preferably, the magnetic means is centrally positioned between the side lengths of the first surface and equal distant between the ends.

The elongated wrap element is generally shaped so that the two ends detachably engage with each other. Side lengths of the elongated wrap element may be essentially parallel to each other, creating a more uniform rectangle for accommodating an upright cup. To accommodate a tapered cup, the side lengths may have a slightly semi-circular shape. The ends are straight or generally curved to ease handleability.

One attachable means resides at the end of the first surface and another communicating attachable means resides on the opposite end of the second surface such that it can detachably engage the first surface attachable means. Attachable means comprise of fasteners such as magnetic or nylon buckles, magnets, snap locks, adjuster bars, zipper pulls, slides or cord locks. The attachment means should be capable of tightly affixing about the container and are preferably selected to offer a way of adjusting the length of the wrap element to thereby accommodate a range of cup sizes.

Generally, an embodiment of the present invention is made according to the following steps. An elongated piece of neoprene of about 1/16–1/2 inch thick, e.g. neoprene having a rough surface and a smoother surface with a backing, is obtained. From a central part of the first surface of the neoprene at least one small square portion is removed. Preferably, the removed portion measures about 1/4–5/8 inch in length by 1/4–5/8 inch in width. It may extend completely through the neoprene resulting in a hole, cut just a superficial depth of the neoprene leaving a crevice on the surface. Multiple portions may be removed depending upon the desired design. For wrap elements in which the portion provides a hole, a patch such as a piece of cloth is affixed to the outside or second surface of the wrap element about the hole portion. One or more magnets are then placed into the hole or crevice. Preferably, this assembly is done by placing the wrap element on a magnetized steel and/or iron plate. The magnetized plate helps to align the magnet polarity, positive side facing outwards, reverse polarity repel hence place attracting side magnet out; or the reverse may be done.

Another cloth, preferably nylon cloth, is affixed to all or a portion of the first surface of the wrap element. VELCRO® end fasteners are affixed to opposite ends of each side of the wrap element so that both ends communicate and removably attach securely to each other. Generally, the cloth and fastener items can be affixed to the neoprene using any convenient means, such as glue, paste, staples, pins or stitches.

The user places the wrap element around a cup and fastens first attachable means to the second attachable means to securely affix it thereabout. Once securely about the cup, this combination can be mounted onto a magnetic accepting support or surface while, additionally, providing standard features associated with cup holders. Useable magnetic accepting surfaces are endless. They can range from outdoor structures, such as a galvanized light post, to an indoor wall support. To disengage the combination from the metal support, the user twists and lifts it off. The user avoids the hassle and strain of balancing a cup in situations where a metal support is nearby, such as a sign at the bus stop, a file cabinet at work, or a parking meter post. Additionally, the wrap element provides insulation to the container contents and manages possible condensation.

An important feature of this invention is that it can be designed to allow the user to use it with a variety of sized cups. Another important feature is that the strength of the magnetic means is significant while the overall weight is not burdensome to the user. Optionally, the user can also use multiple wrap elements simultaneously together, i.e., one wrap element is secured about a surface or worn about a limb of a person and another wrap element, of opposite polarity, is removably attached thereto at magnetic means.

Other features, aspects and advantages of the present invention will become better understood or apparent from a perusal of the following drawings, detailed description of the invention and appended claims.

BRIEF DESCRIPTION OF THE DRAWINGS

In the drawings which are attached hereto and made a part of this disclosure.

DETAILED DESCRIPTION OF THE INVENTION

Figure 1:
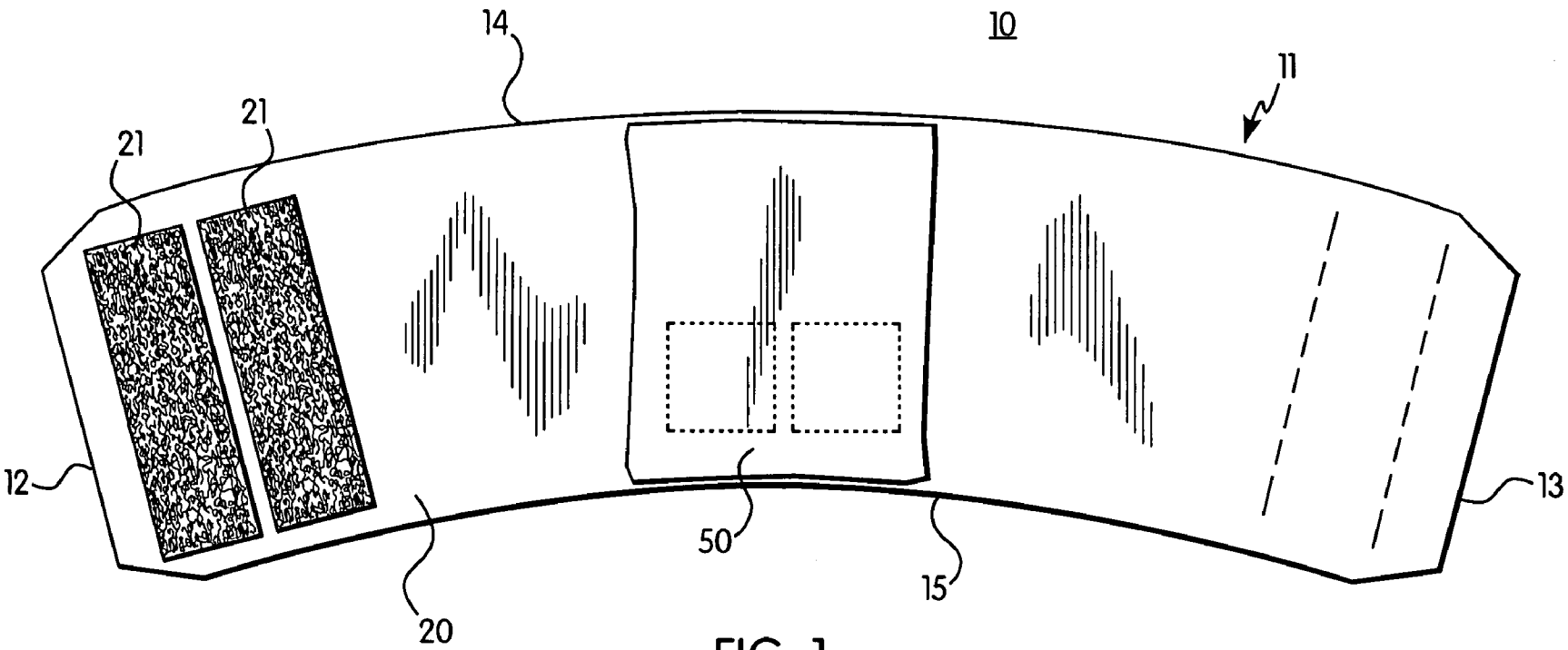
FIGS. 1 and 1*a* illustrate a top view of two embodiments of a first surface of the present invention.
Figure 1A:
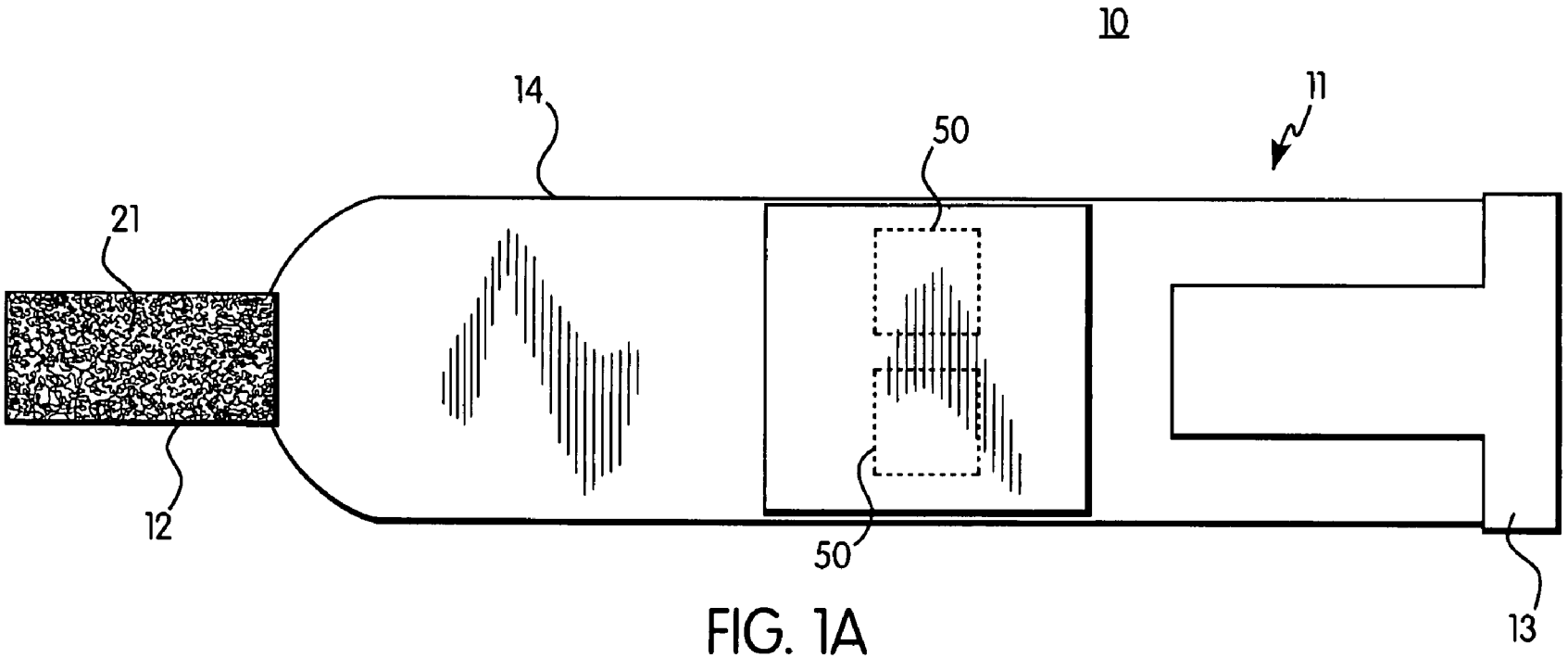

In a presently preferred embodiment of the present invention, by reference to FIG. 1, a cup holder 10 is shown unassembled and is in the form of an elongated wrap element 11. Wrap element 11 is defined by a length having two distal ends, 12 and 13, and two sides, 14 and 15, a first surface 20 and a second surface 30. Optionally, it has a bottom 17. Each of surfaces 20 and 30 also has an attachment means, 21 and 31, that is designed to removably attach with the other and be positioned along wrap element 11 at opposite ends from one another. A magnetic means 50 is provided on or in a portion of the first surface 20.

In one embodiment, wrap element 11 is constructed out of a piece of neoprene having a thickness of about 1/16 to 1/2 of an inch, preferably about 1/8 of an inch. The length varies. Preferably, it is about 10 to 14 inches, and more preferably the length is about 11 to 11 1/2 inches. First and second surfaces can have a texture to improve gripability with a cup and/or the user. Grip may be further enhanced with installation of an additional covering. A decorative pattern can be applied to the first surface 20. It may be print directly on first surface 20 or comprise an additional layer of natural or synthetic cloth, such as nylon cloth affixed thereto.

Figure 2:
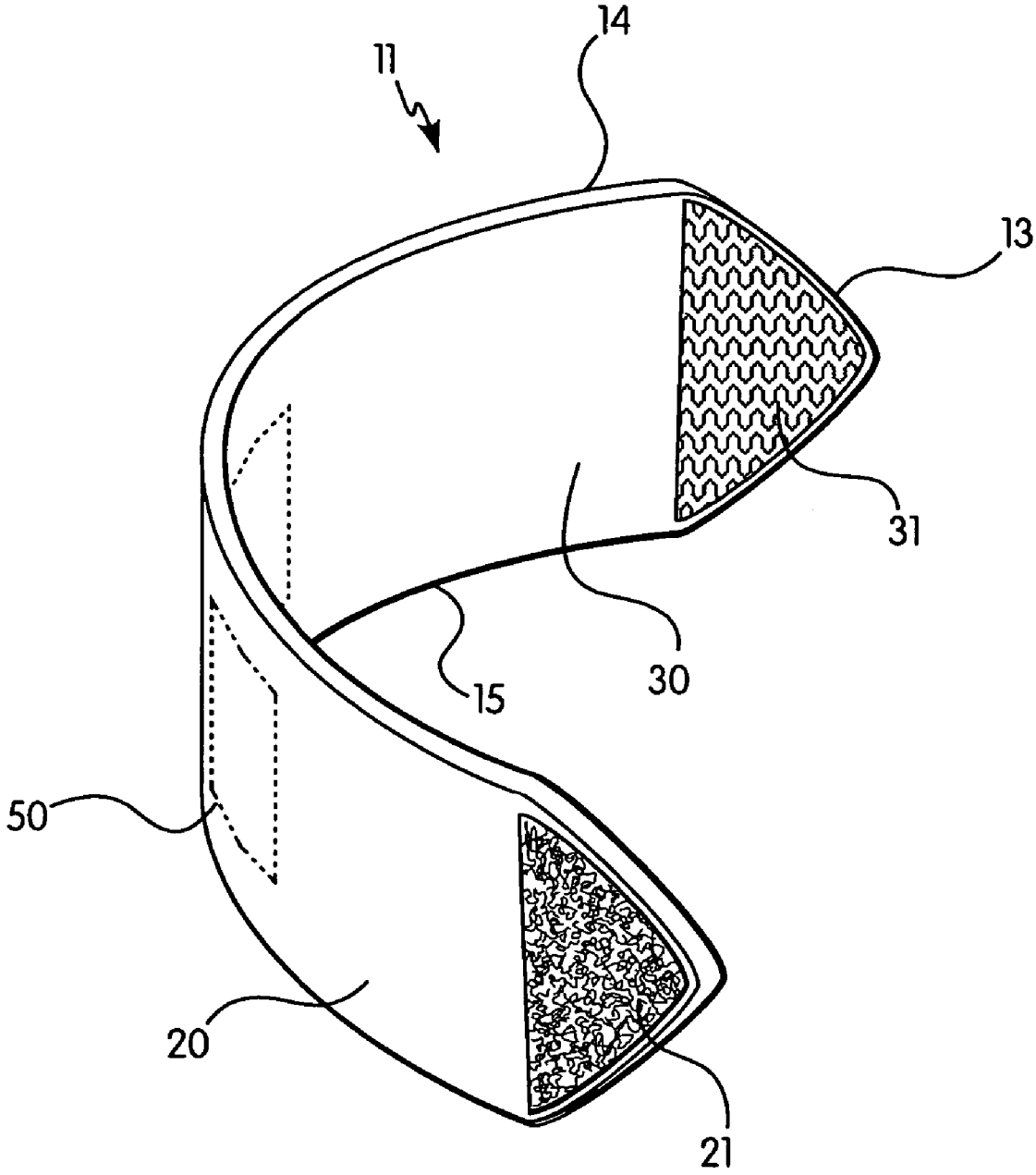
FIGS. 2 and 2*a* show a perspective view of two embodiments of the present invention.
Figure 2A:
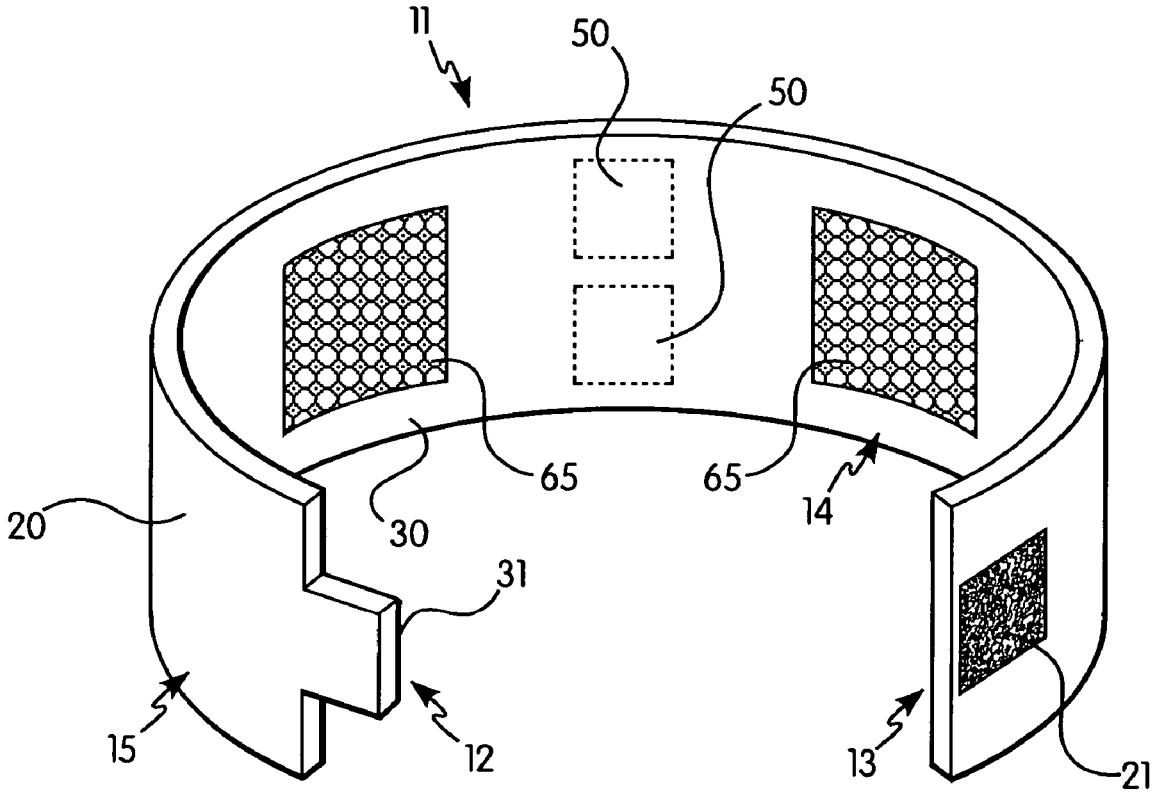

The attachment means, 21 and 31, are positioned so that when wrap element 11 is used in combination with a cup they detachably engage with each other thereby allowing the wrap element 11 to adapt tightly to the contours of the cup. In an embodiment of the invention, first surface attachment means 21 is provided near to end 12 in a position between sides 14 and 15, as shown in FIG. 1. As shown in FIG. 2, second surface attachment means 31 is provided on second surface 30 along end 13 in a position between sides 14 and 15. The attachment means 21 and 31 are designed to detachably engage each other when they are fastened together. Preferably, the attachment means 21 and 31 comprise fasteners, magnets or hook and latch closures, such as VELCRO®. For example, first attachable means 21 contains the hooks and second attachable means 31 contains a receiving latch closure. The selected attachment means is capable of providing a reliable hold sufficient to support a liquid-containing device according to the present invention.

Magnetic means 50 may consist of one or more magnets. In an embodiment, the magnetic means 50 consists of a relatively small magnet that has a magnetic force superior to that of a commonly known and used magnet (e.g., refrigerator magnet). Typically, such common magnets have strength of about 2.0–4.3 kilogauss. Preferably, magnetic means 50 contains a magnet 51 having a strength of about 30 to 42 MGO. In a more preferred embodiment a 35 MGO (neodymium 35) ($Nd_2Fe_{14}B$) magnet is used, and the magnet is about a 1/4 to 1/2 inch square in size and about 1/32 inch thick. Preferably, magnetic means 50 is centrally positioned on the first surface 20, although other positions work amply as well. In an alternative embodiment, magnetic means 50 is located at or near to an end of wrap element 11 and a corresponding attracting part is at the other end on the opposite surface of the wrap element thereby providing the dual the functionality of bat magnetic means 50 and attachment means 21 and 31.

Figure 3:
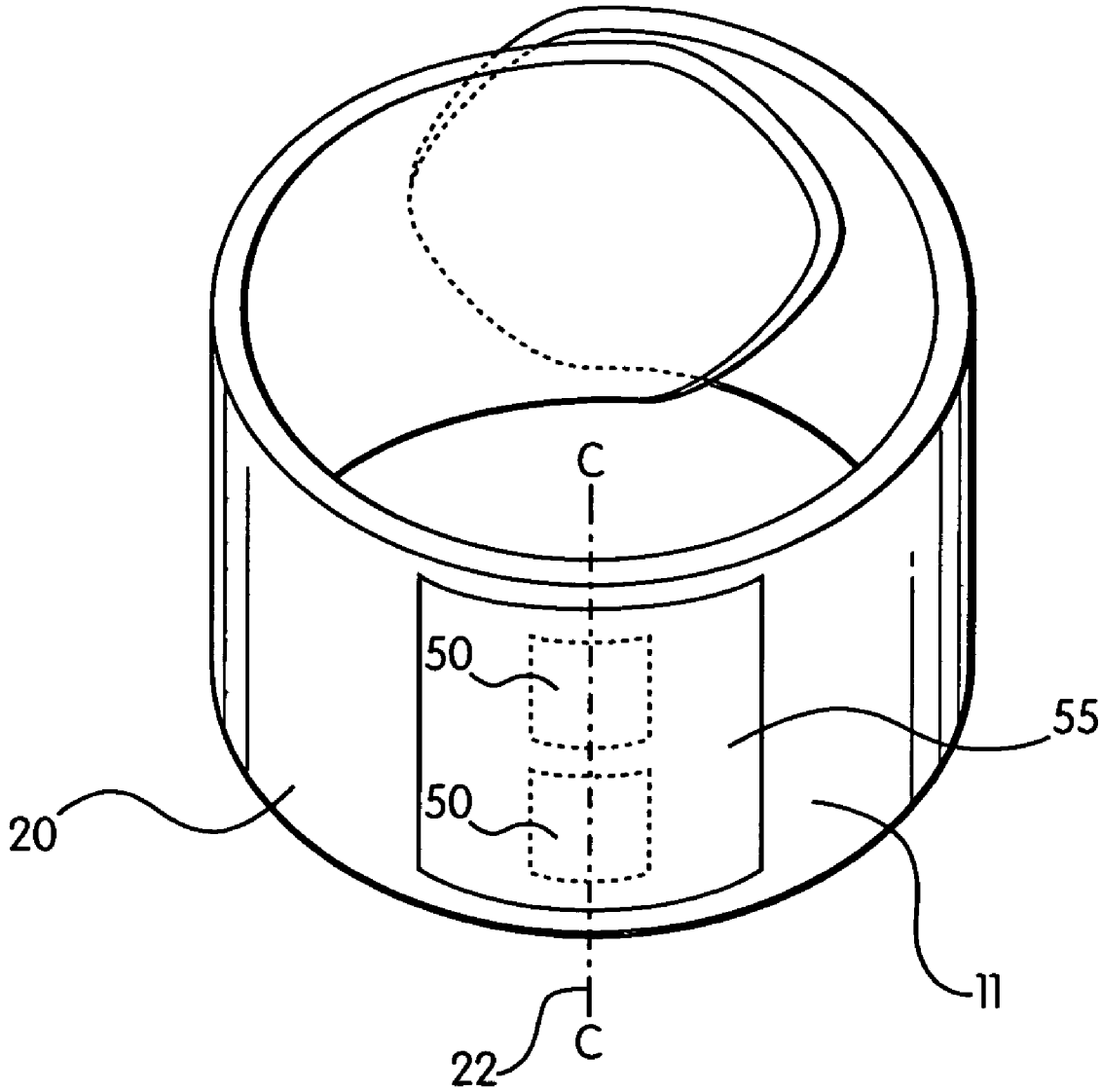
FIG. 3 shows a top perspective view of an embodiment of the wrap element in an attached position.
Figure 4:
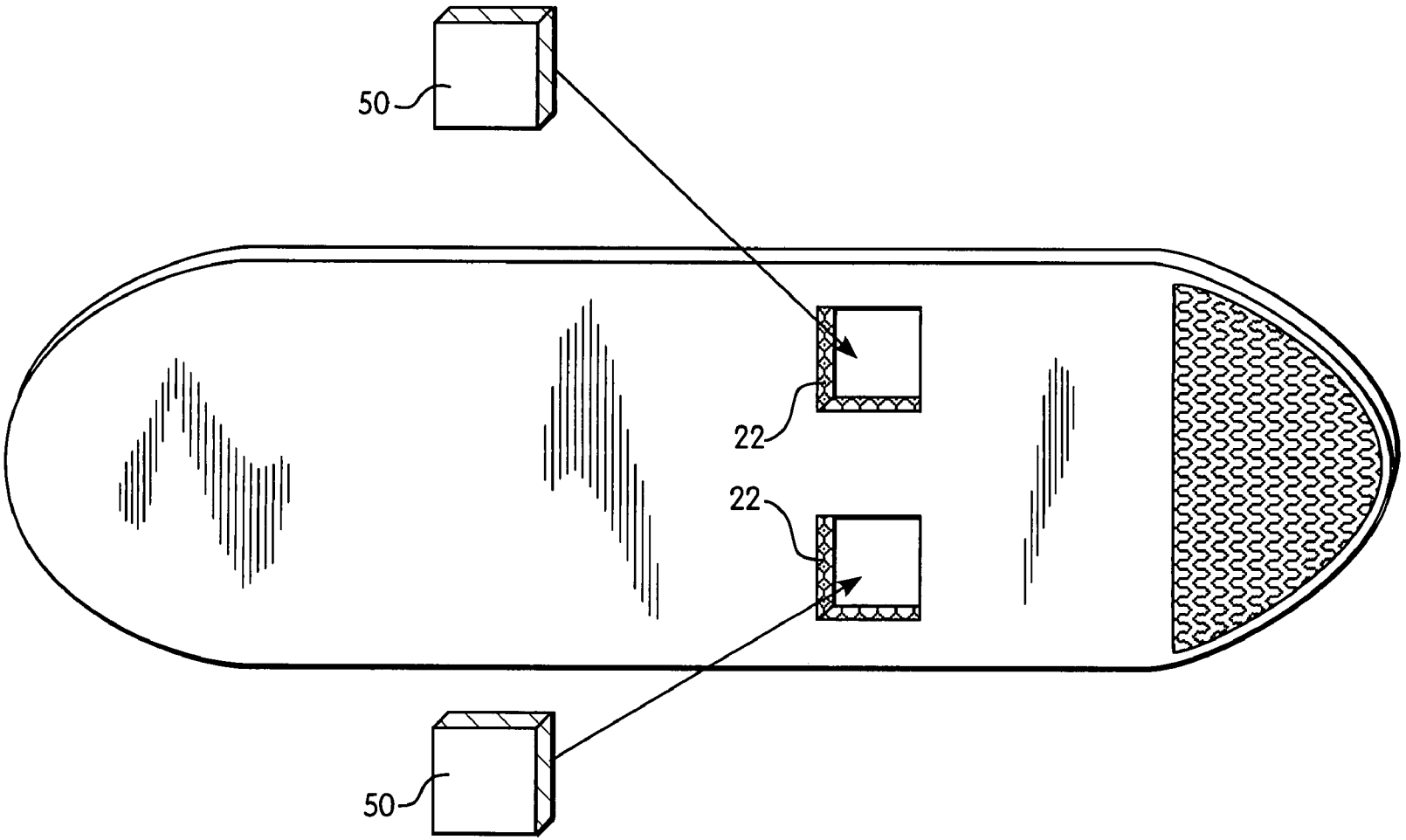
FIGS. 4 and 4*a* illustrate a top view of the first surface having two crevices for holding a magnetic means in two embodiments of the present invention.
Figure 4A:
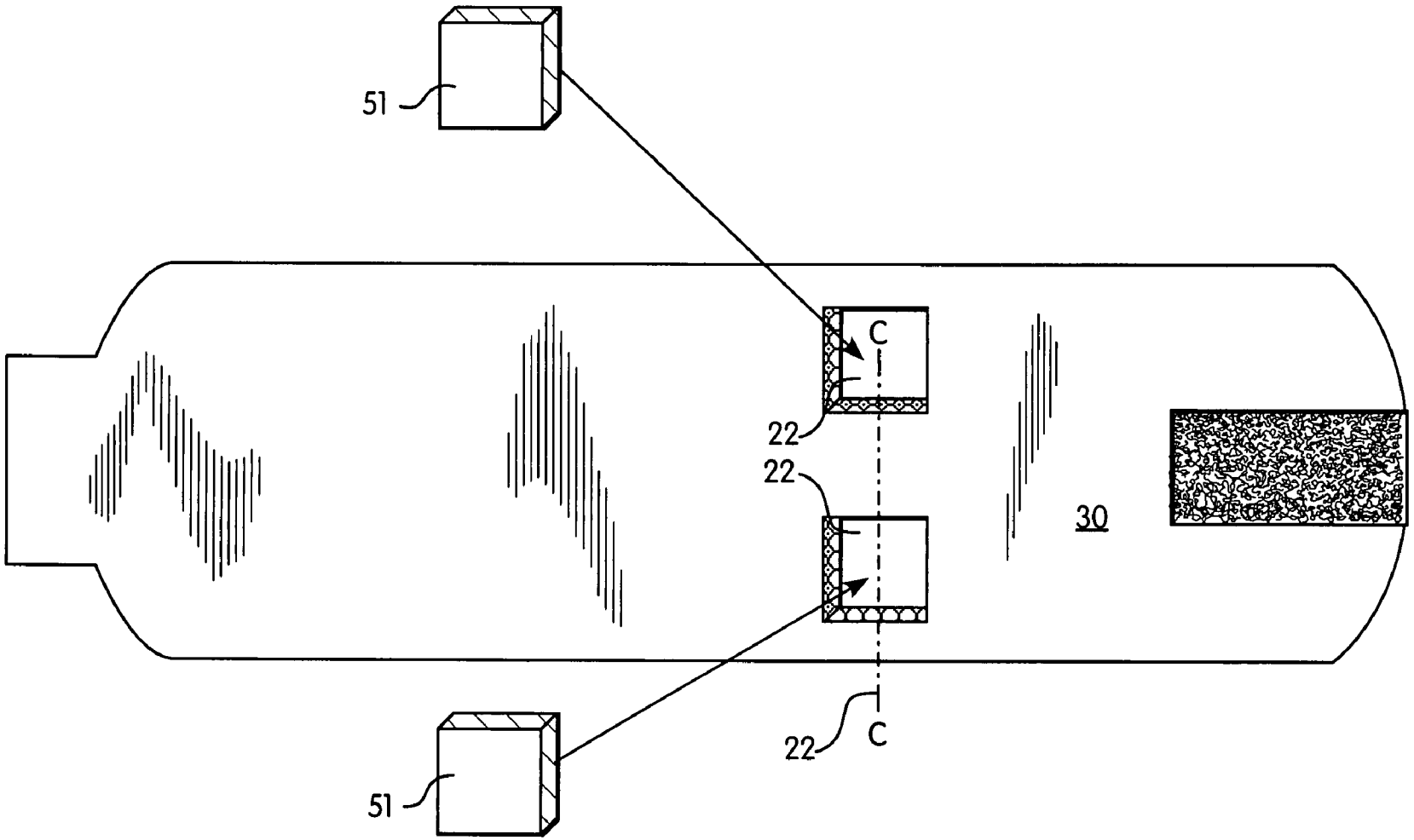
Figure 5:
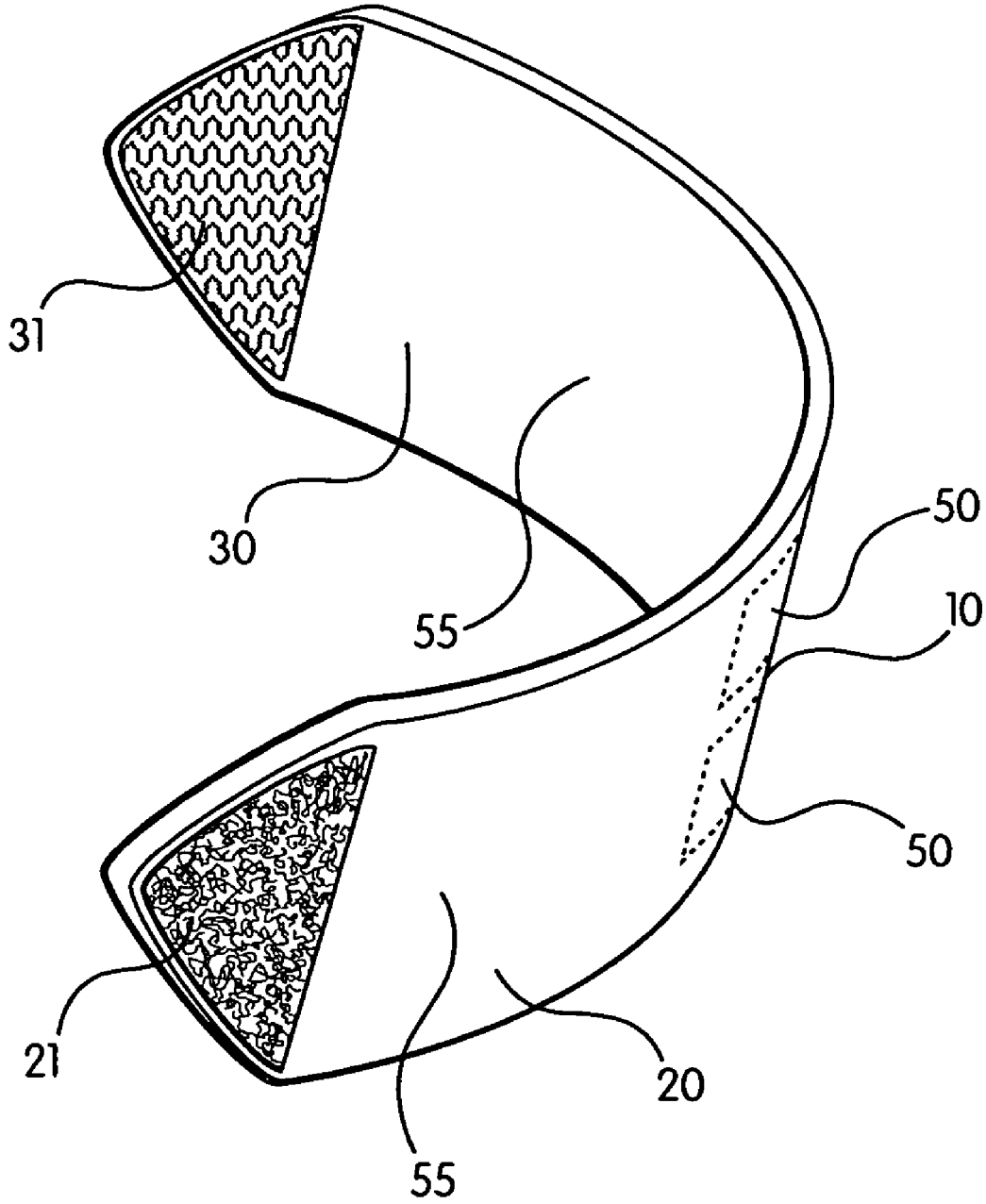
FIGS. 5 and 5*a* show another perspective view of two embodiments of the present invention.
Figure 5A:
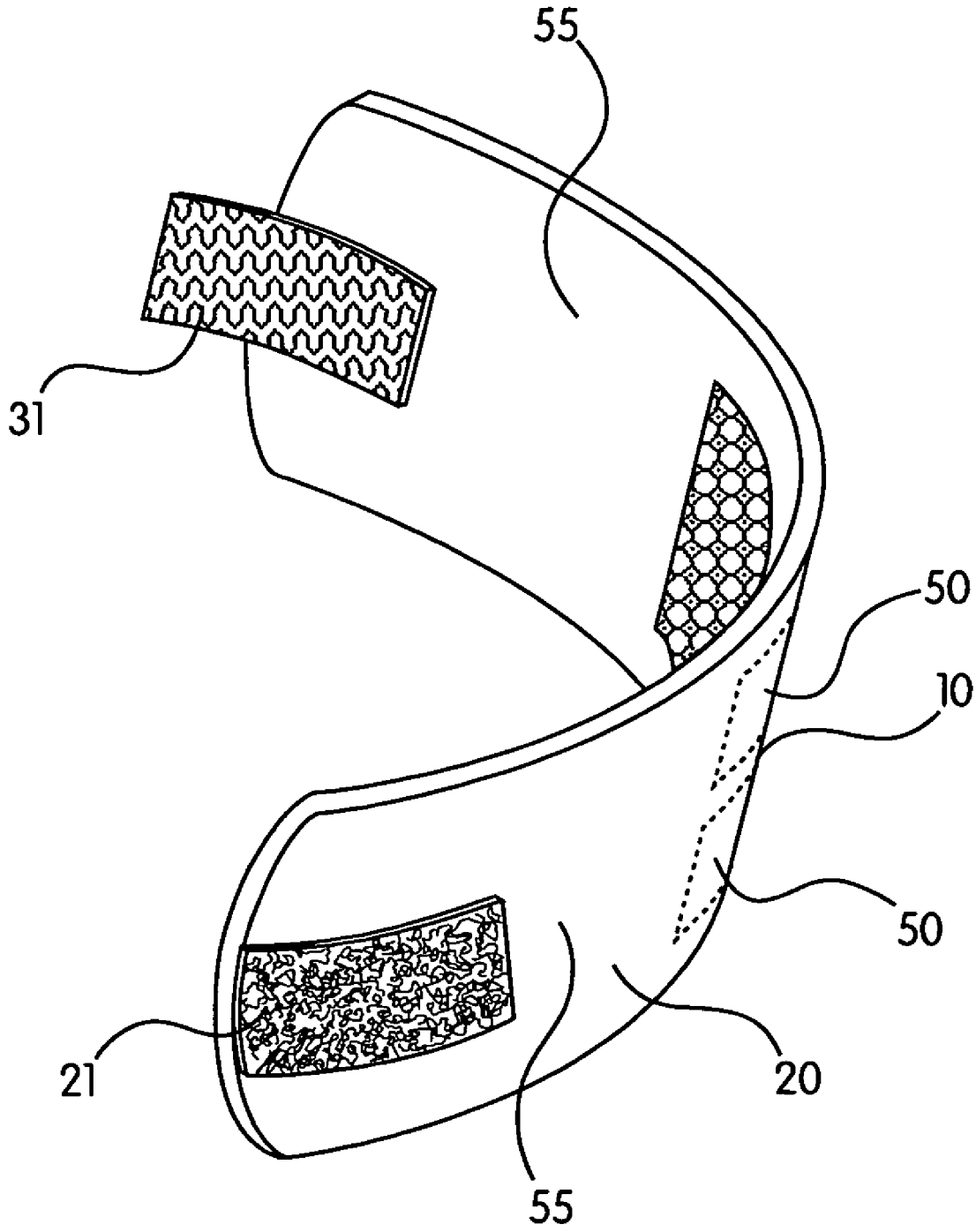
Figure 6:
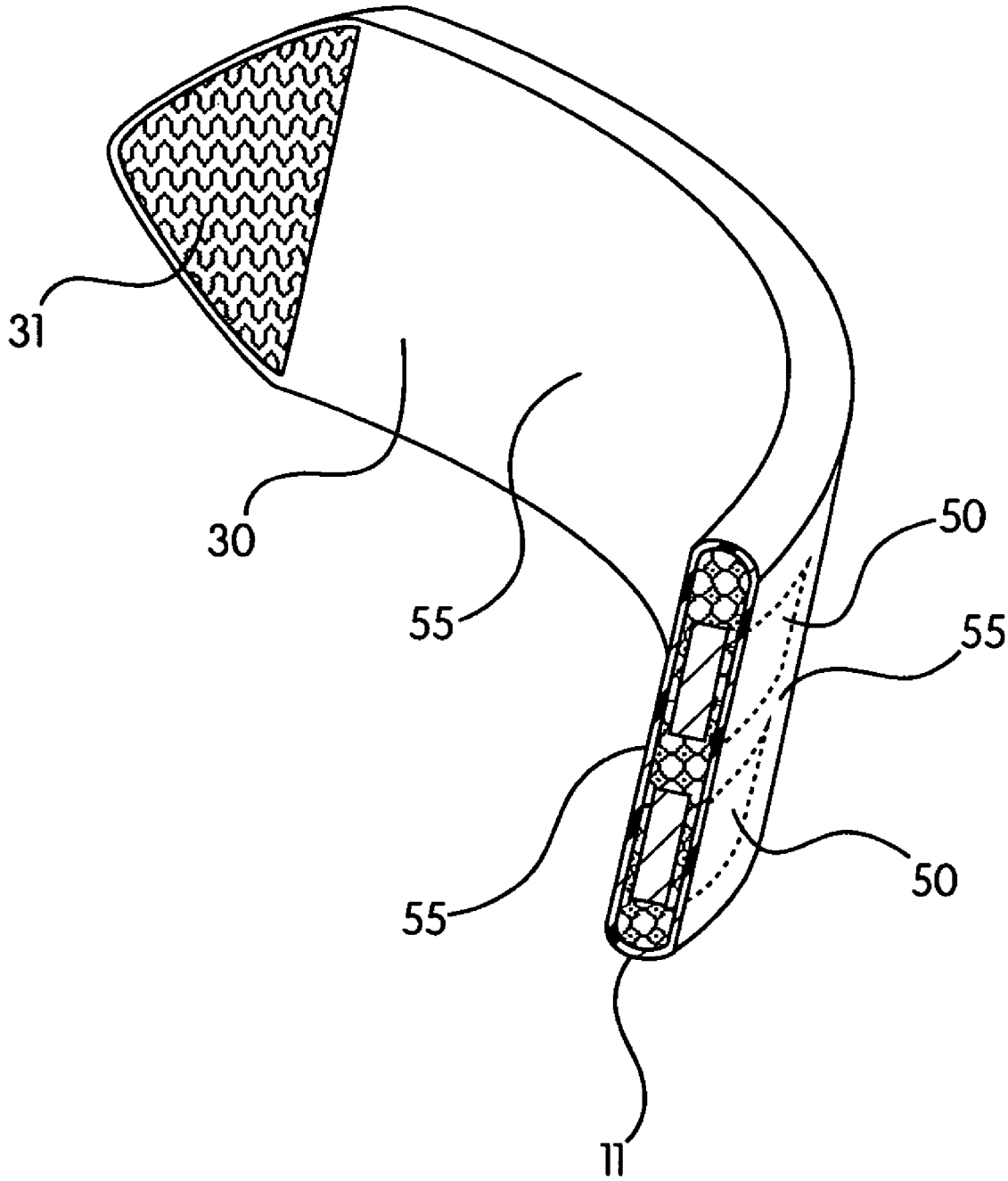
FIGS. 6 and 6*a* provide a cross section of the wrap element attachment means in an embodiment of the present invention.
Figure 6A:
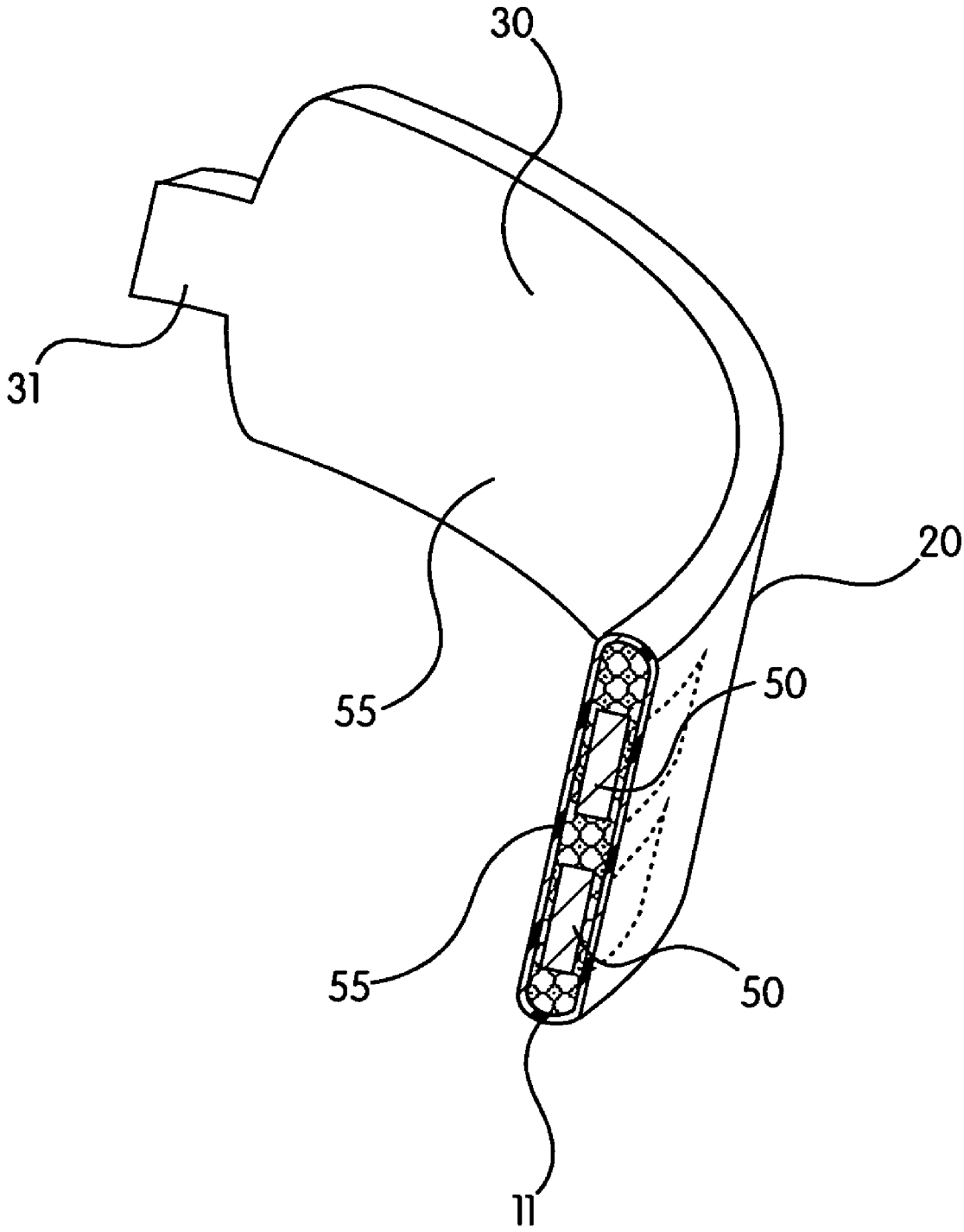

Magnetic means 50 can be affixed to the first surface 20 with adhesive and covered with a protective coating or patch 55 to secure it to first surface 20 as illustrated in FIG. 3. The protective coating 55 can be a laminant or include a piece of nylon-cloth that is about 1/32 inch or less in thickness and be sized just large enough to cover magnet means 50. It can also provide an excess trim for holding to said first surface 20, such as in FIG. 1. The protective coating 55 can also cover the entire first surface 20 of wrap element 11. Preferably, it has the dimensions of 2 ¼ to 2 ½ width by 11¼ length Alternatively, multiple magnets 51 are provided in a crevice or indent portion 22 of the first surface 20, as shown in FIG. 4. Indent portion 22 includes a portion of the first surface 20 that has a width and depth contoured to the dimensions of the magnetic means 50 and, preferably, as illustrated in FIGS. 5 and 6, such that the top surface of magnetic means 50 is flush with the first surface 20.

Figure 7B:
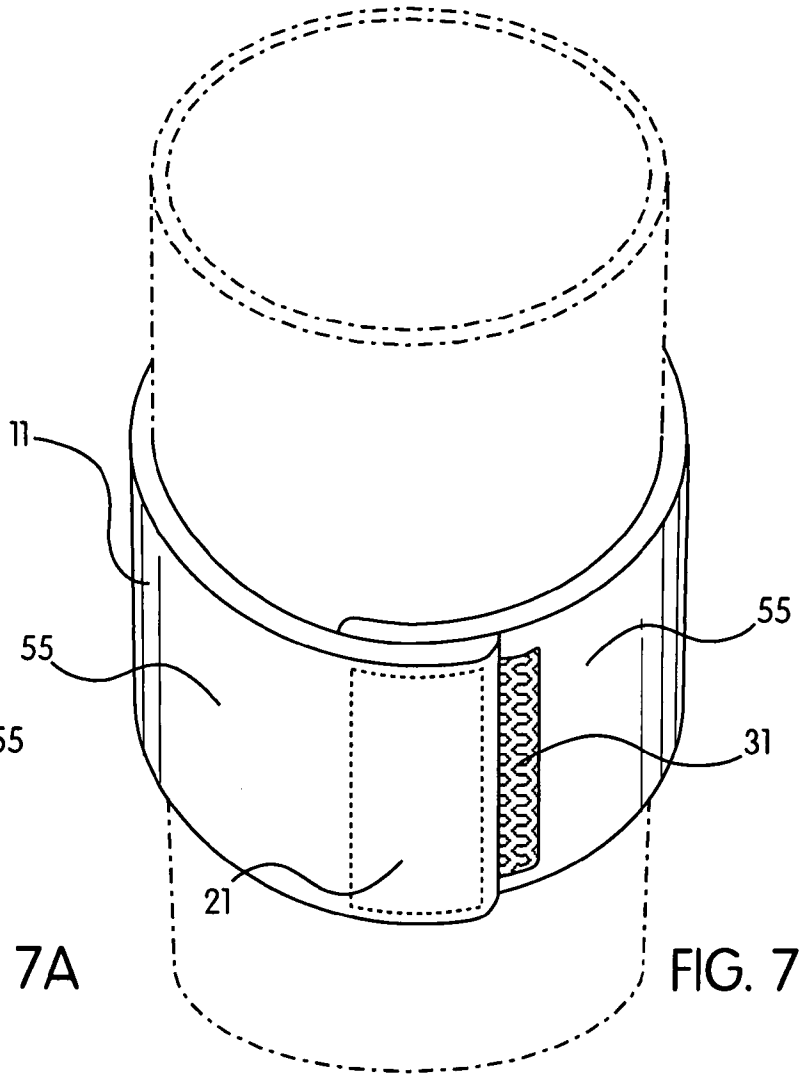
FIGS. 7*a* and 7*b* show perspective views of an assembled cup holder formed to hold a cup according to an embodiment of the present invention.
Figure 7A:
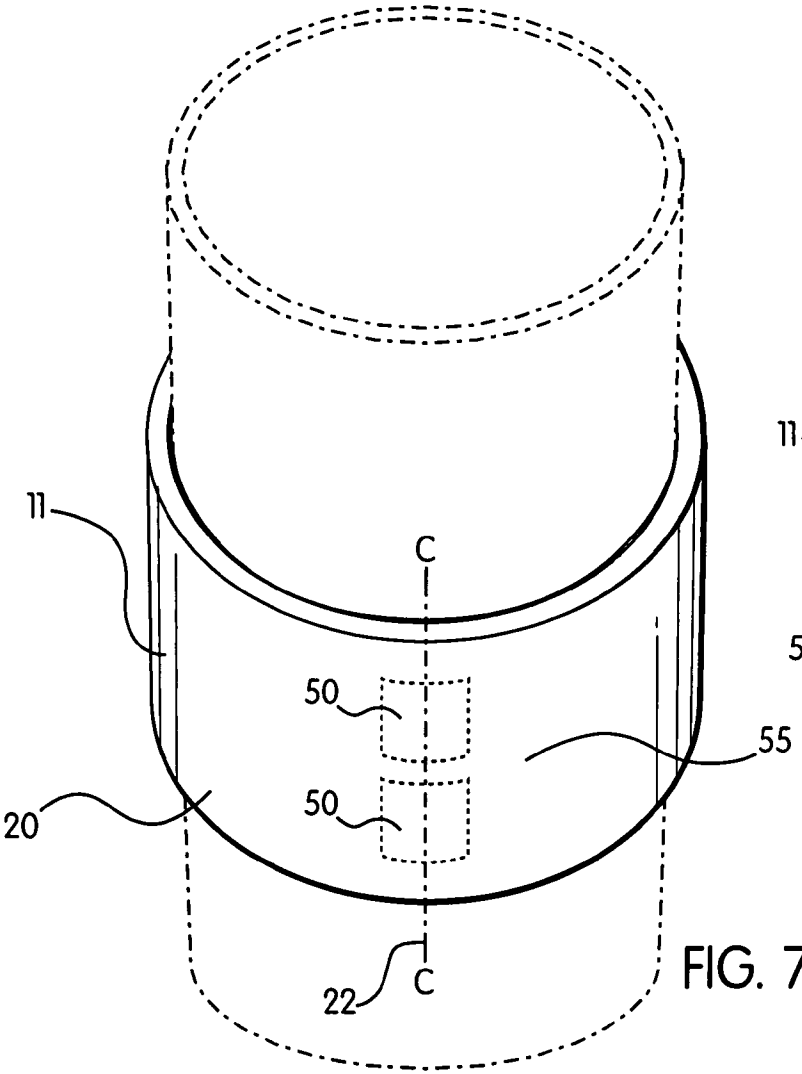

The wrap element 11 is essentially rectangular in shape. Preferably, it has a slight curvature giving a semi-circular shape along sides 14 and 15 and rounded distal ends 12 and 13. The curvature can be adjusted to form a conical shape that accommodates tapered cups or provides greater support and gripability to traditional cylindrical cups. When in use, a user simply places wrap element 11 about a cup or mug and overlaps the two attachable ends 21 and 31 so that they securely join with each other as illustrated in FIGS. 7*a* and 7*b*. Once the cup is tightly fit about the cup, the holder combination can be mounted onto any metal magnetic accepting support by positioning the portion of the cup holder having the magnetic means against the metal support. To disengage the holder combination, it is twisted slightly at the magnet and lifted off. The mechanics of this will become evident when in use.

Figure 8:
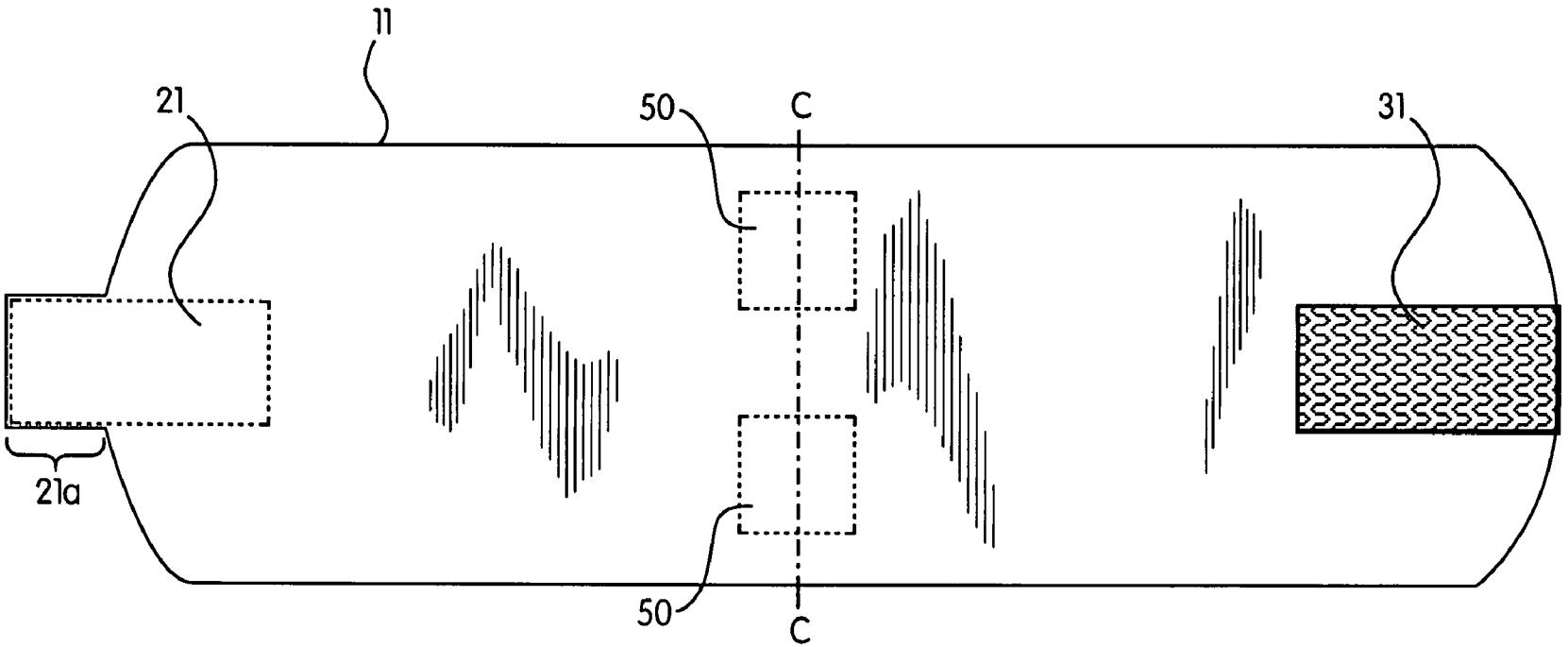
FIG. 8 shows a plan view of one surface of an embodiment of the present invention wherein one end attachment means has a tab portion.

In another embodiment of the invention, attachment means 21 and 31 are incorporated into the wrap element 11 and flush with the exterior surface. One (or both) attachment means can have an adjustable point of closure with the corresponding attachment means. It can comprise a tab or extended portion. Attachment means 21 (and or 31) may form a tab portion 21*a* extending the length of a part of one end of the wrap element, as in FIG. 8. In a preferred embodiment, Tab 21*a* extends part of the end by about ½ inch and measures about one inch wide. Tab 21*a* can thereby ease disengagement of the attachment means for removing the wrap element from a container, and accommodate an increased range of container shapes and sizes.

Figure 9:
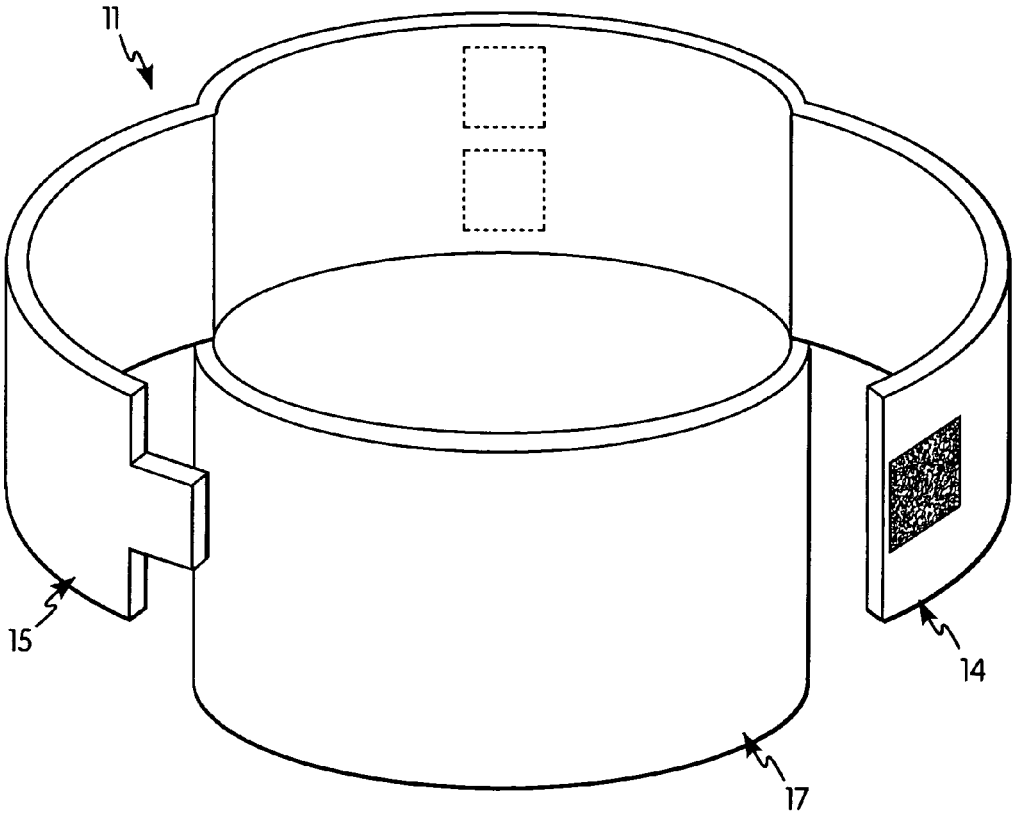
FIG. 9 shows a perspective view of an embodiment of the present invention having a bottom.
Figure 10:
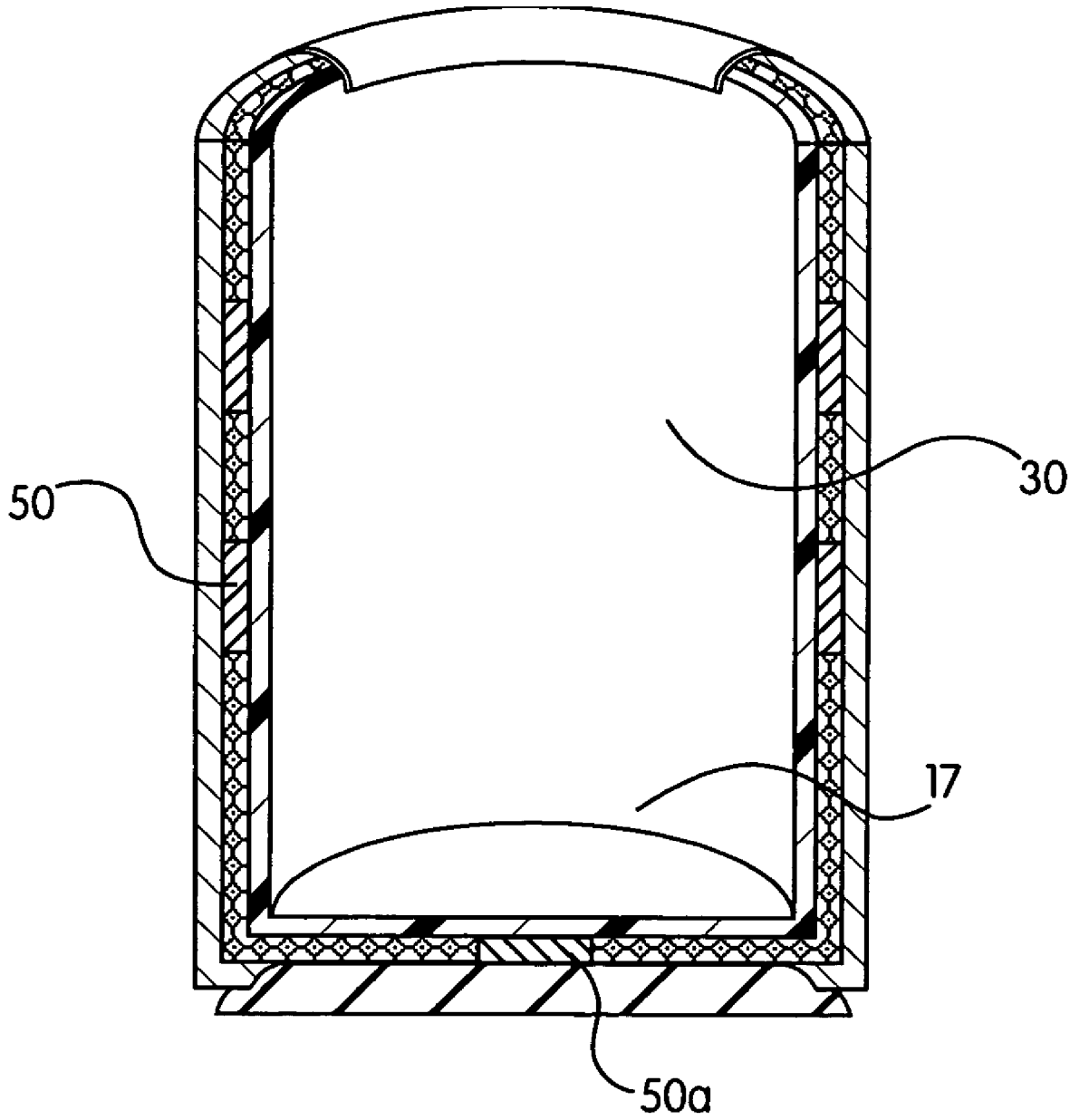
FIGS. 10 and 10*a* illustrate a cross section of the wrap element having a bottom portion in two embodiments of the present invention.
Figure 10A:
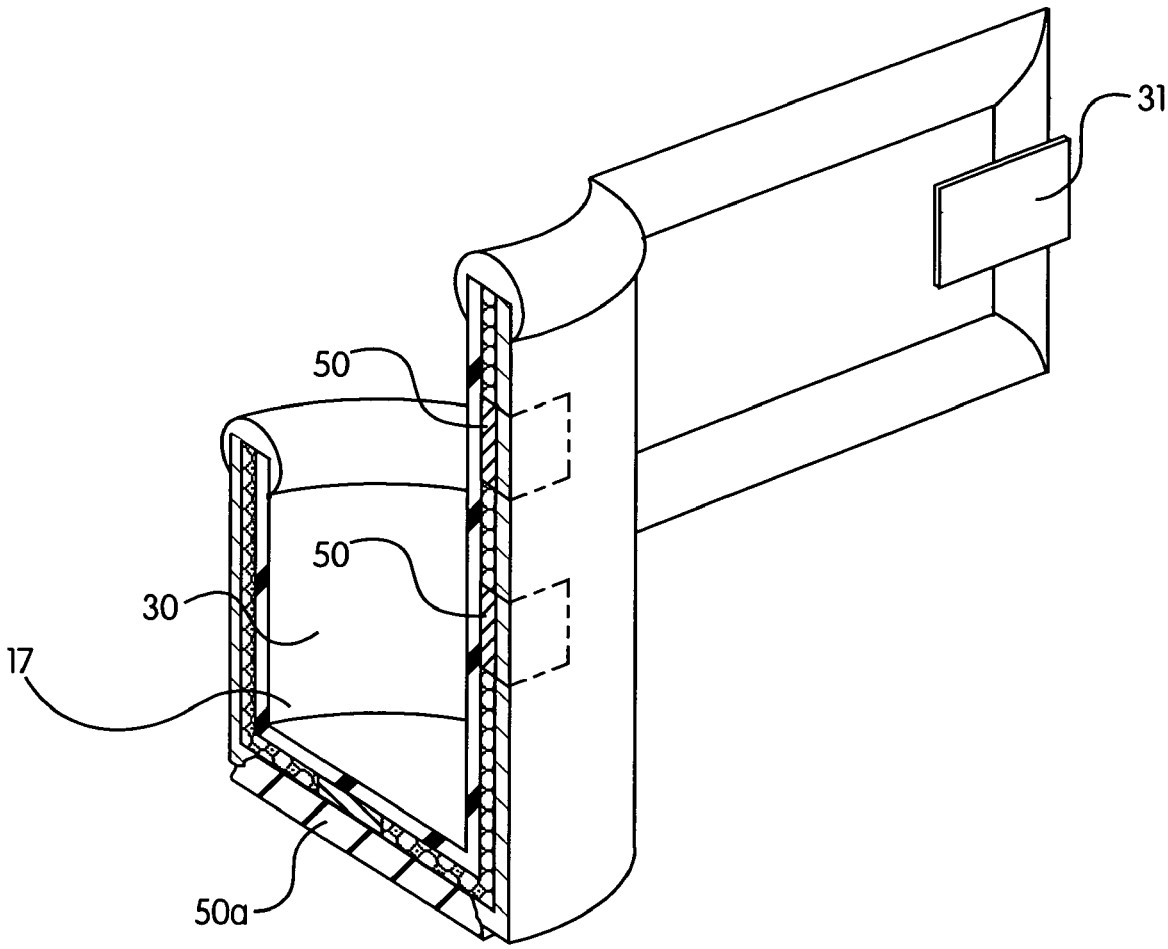

A bottom portion 17 can be provided with the holder as illustrated in FIG. 9 or, alternatively, as in FIG. 10, in another embodiment of the present invention. Bottom 17 is attached to or incorporated into one of the side lengths, 14 or 15, of wrap element 11 to provide additional support for holding the cup in place and to prevent it from slipping out should the grip not be properly secured. Preferably, bottom 17 folds and expands, and is comprised of a flexible material, such as polyester, neoprene or an elastic cloth or web material, and is foldable. In a preferred embodiment, bottom portion 17 is comprised of the same piece of material as wrap element 11 to resemble a single unit and, may be cast from the same piece of material to form an integrated single unit. FIG. 10 shows a cross-sectional view of the single unit wrap element for encircling a beverage.

Figure 11:
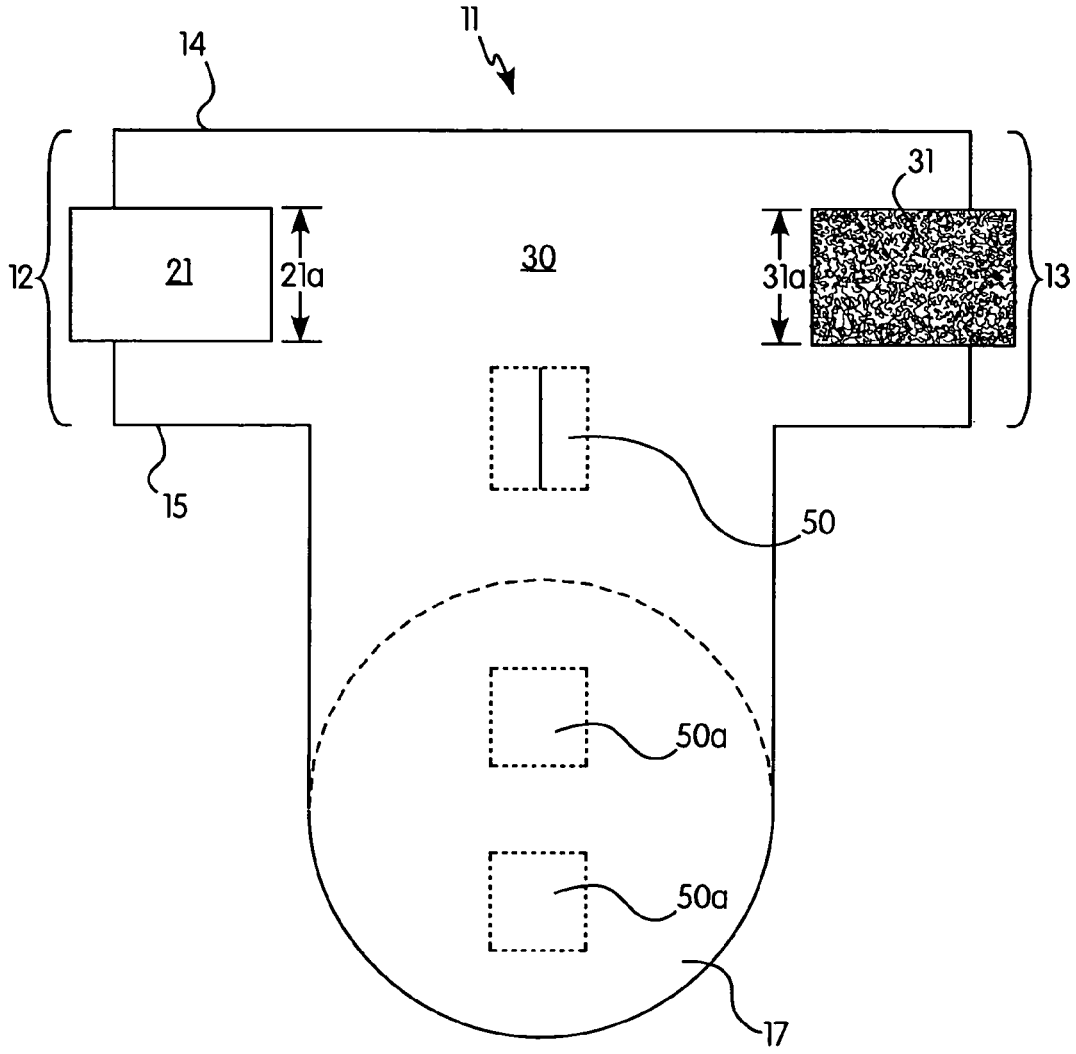
FIG. 11 illustrates another view of the wrap element with bottom portion having a magnetic means.

In another embodiment, if separate, bottom portion 17 can be removably attached or partially or entirely affixed to the length 14 or 15, by any mechanism that ensures its fit, including fasteners, stitches, snaps, zippers, etc., such as in FIG. 11.

The bottom 17 can also include a magnetic means 50*a*. This may be the same or different as magnetic means 50, but preferably employs one or multiple magnets 51*a*. Ideally, magnet 51*a* is of the same power and dimension as that of magnet 51. It can sit on bottom 17 or in a crevice thereof, much like on the wrap element first surface 20, as shown for example in FIGS. 10 and 11.

In another embodiment, multiple cup holders 10 are used together. One wrap element 11 is secured about the arm of a wood chair. Another wrap element, holding a container, is removably attached to the first holder at their respective magnetic means. To successfully hold, the magnet means must have opposite polarity. One of the means may also be wrapped about an arm or leg of a person. It is contemplated that the invention will offer multiple applications. The length of the wrap element can be adjusted to accommodate various sizes of liquid-containing devices. For instance, in addition to holding cups and mugs, it has been designed to hold bottles for disinfectants, window wash, shampoos, etc.

Figure 12:
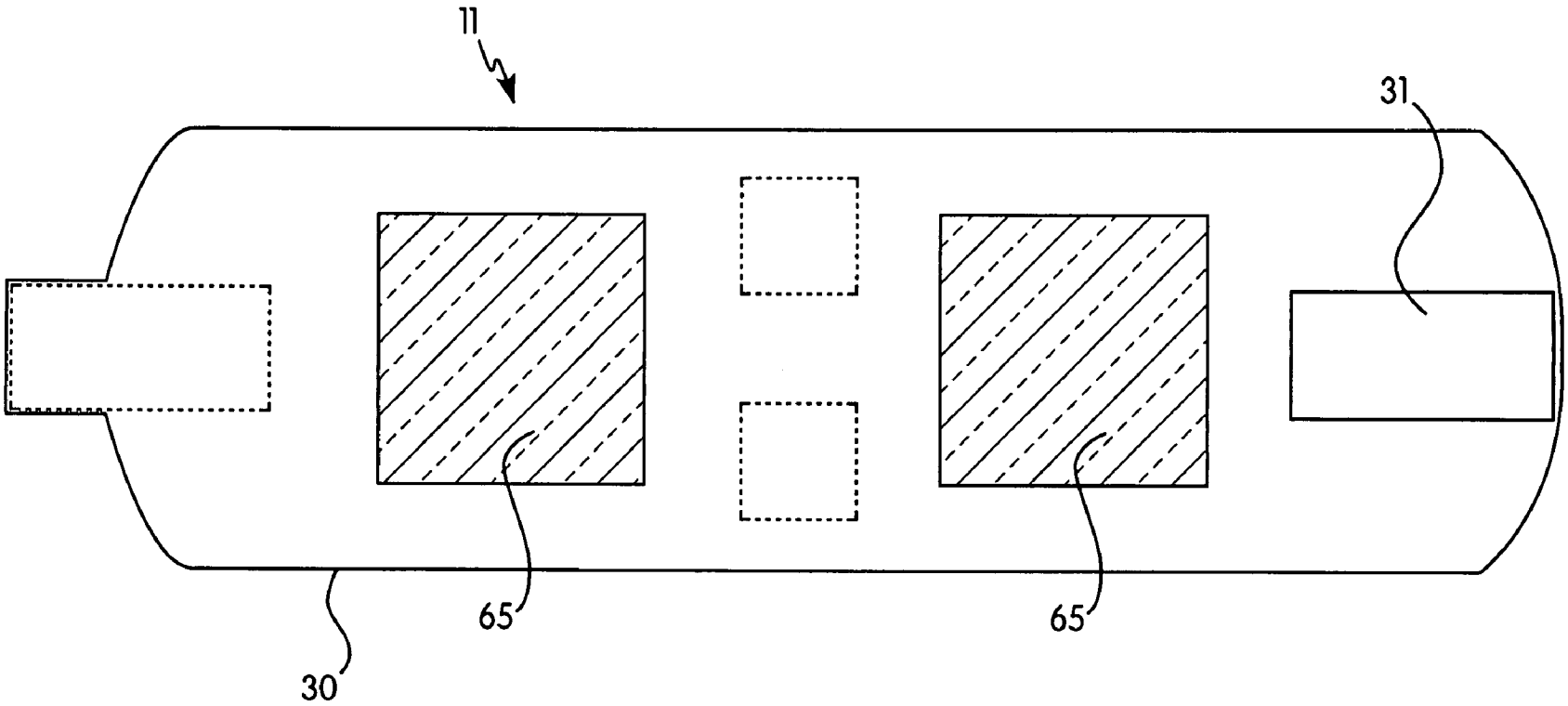
FIG. 12 shows an embodiment of the second surface of the present invention having exposed texture portions.

Cup holder 10 can be provided with a decorative covering along a portion or the entire length as shown in FIG. 1. Decorative elements can be incorporated into the neoprene substrate or affixed thereto. Such decoration includes, for example, of commercial information, company logo, art, scenic, advertising etc. The cup holder 10 can further have a texture. As indicated in FIG. 12, covering 60 is applied to second surface 30 leaving one or more openings 65 to the second surface 30. Surface 30 can be the neoprene or other substrate used, thereby increasing the gripability of wrap element 11 when contact with a container. Textured neoprene should add to gripability especially when in the container "sweats" or condensation forms. The texture, for example, includes a silky nylon cloth similar to some camping gear. Other combinations of openings 65 with surface 30 can prove advantageous. These features can be selected and refined for the desired use and design of the wrap.

EXAMPLE

By way of an example, a cup holder was constructed in accordance with the perimeters disclosed herein. One-eighth of an inch thick piece of neoprene was cut to have a semi-curved shape. The length was about twelve inches and width of about two inches to four inches. Two pieces of VELCRO® were attached at one end of the first surface oriented essentially parallel to the end and the two cooperating pieces at the opposite end on the second surface aligned to pair with those on the first surface. Two magnets of about ½ inch square were affixed to the center of the first surface with a rubber cement adhesive and covered with a patch using nylon cloth.

The wrap element was then wrapped into an essentially cylindrical shape about a soda can. The combination was placed against the metal post of a street sign and positioned so the magnetic means was against the magnetic accepting surface of the post. It immediately held fast to it. The combination was tested and found to mount effectively while supporting cups containing liquids weighing up to about one pound. The combination was removed by twisting and lifting it from the post.

While the foregoing has been set forth in considerable detail, the embodiments and preferences are presented for elucidation and not limitation. It will be appreciated from the specification that various modifications of the invention and combinations of elements, variations, equivalents, or improvements therein may be made by those skilled in the art, and are still within the scope of the invention as defined in the appended claims.

What is claimed is:

1. An improved beverage container holder that can be adapted to receive a beverage container having a bottom portion, and that can be mounted on a metal surface, comprising:

a) a foldable single unit wrap element comprising an integrated cylindrical portion made from a flexible material and having a lower side length, configured to encircle the bottom portion of a beverage container, and a bottom attached along the lower side length of the integrated cylindrical portion, and b) at least one magnetic means affixed to and secured to the integrated cylindrical portion of the wrap element, the magnetic means comprising a neodymium magnet having a strength of at least about 30 MGO.

2. The improved beverage container holder of claim 1 comprising a plurality of the neodymium magnets.

3. The improved beverage container holder of claim 2 wherein the plurality of neodymium magnets are secured between an outer surface of the integrated cylindrical portion and the protective coating.

4. The improved beverage container bolder according to claim 1 wherein the flexible material is neoprene.

5. The improved beverage container holder of claim 1 wherein the at least one magnetic means is secured with a protective coating.

6. The unproved beverage container holder of claim 5 herein the at least one magnetic means is secured between an outer surface of the cylindrical body and the protective coating.

7. An improved beverage container holder that can be adapted to receive a beverage container having an upper exposed portion and a lower portion, the holder comprising:

a) a foldable, flexible single unit wrap element comprising an integrated cylindrical portion having a lower side length, and configured for encircling a lower portion of a beverage container, thereby exposing the upper exposed portion of the beverage container, the wrap element having a first surface and a second surface adapted to be in contact with the beverage container;

b) a bottom portion attached along the lower side length of the integrated cylindrical portion;

c) a plurality of magnetic means positioned on the first surface, comprising a plurality of neodymium magnets having a strength of about or greater than 30 MGO; and d) a protective coating covering the magnetic means.

8. The improved beverage container holder of claim 7, further comprising a first attachable means on the first surface of the wrap element, and a second attachable means formed as a tab portion that can engage the first attachable means.

9. The improved beverage container holder according to claim 7 wherein the foldable, flexible single unit wrap element is neoprene.

10. A beverage container holder that can be magnetically mounted to a vertical magnetic-accepting surface to hold a beverage container received therein on the vertical surface, comprising:

a. a foldable cylindrical body made from a flexible material and having a lower edge;

b. a foldable bottom affixed to the cylindrical body along the lower edge; and c. at least one magnet affixed to at least a portion of the cylindrical body, the at least one magnet comprising a neodymium magnet having a strength of at least 30 MGO.

11. The beverage container holder according to claim 10 wherein the flexible material is neoprene.

12. The beverage container holder according to claim 11 wherein the foldable bottom is neoprene.

13. The beverage container holder according to claim 10 wherein the at least one magnet is at least about 35 MGO.

14. The beverage container holder according to claim 10, comprising a plurality of the neodymium magnets.

15. The beverage container holder according to claim 10 further comprising a neodymium magnet attached to the foldable bottom.

16. The improved beverage container holder of claim 15 further comprising a protective coating that covers and secures the bottom neodymium magnet to the foldable bottom.

17. The improved beverage container holder of claim 10 wherein the at least one magnet is secured to the cylindrical body with a protective coating.

18. The improved beverage container holder of claim 17 wherein the at least one magnet is secured between an outer surface of the cylindrical body and the protective coating.

* * * * *

UNITED STATES PATENT AND TRADEMARK OFFICE

CERTIFICATE OF CORRECTION

PATENT NO. : 7,021,594 B2
APPLICATION NO. : 10/851252
DATED : April 4, 2006
INVENTOR(S) : Timothy W. Exler It is certified that error appears in the above-identified patent and that said Letters Patent is hereby corrected as shown below:

Claim 4, line 33, delete “bolder” and insert --holder--.

Claim 6, line 38, delete “unproved” and insert --improved--.

Signed and Sealed this

Second Day of January, 2007

JON W. DUDAS
*Director of the United States Patent and Trademark Office*